US009232820B2

(12) United States Patent
Henley et al.

(10) Patent No.: US 9,232,820 B2
(45) Date of Patent: Jan. 12, 2016

(54) HIGH SPEED OBJECT INSERTER AND RELATED METHODS

(75) Inventors: Shawn Henley, Mechanicsville, VA (US); Robert Amiss, Lanexa, VA (US); Wilfried Hoffmann, Locust Hill, VA (US)

(73) Assignee: Hauni Maschinenbau AG, Hamburg (DE)

( * ) Notice: Subject to any disclaimer, the term of this patent is extended or adjusted under 35 U.S.C. 154(b) by 855 days.

(21) Appl. No.: 13/071,945

(22) Filed: Mar. 25, 2011

(65) Prior Publication Data

US 2012/0245006 A1 Sep. 27, 2012

(51) Int. Cl.

| | |
|---|---|
| ***A24D 3/06*** | (2006.01) |
| ***A24D 3/02*** | (2006.01) |
| *B31C 99/00* | (2009.01) |

(52) U.S. Cl.

CPC ..... *A24D 3/0216* (2013.01); *A24D 3/061* (2013.01); *A24D 3/02* (2013.01); *A24D 3/0233* (2013.01); *B31C 13/00* (2013.01)

(58) Field of Classification Search

USPC ..... 493/39, 42, 47, 48, 49
IPC ..... B31C 13/00; A24D 3/061,3/00, 3/02, A24D 3/0233
See application file for complete search history.

(56) References Cited

U.S. PATENT DOCUMENTS

| | | | | |
|---|---|---|---|---|
| 3,370,514 | A * | 2/1968 | Rome | 493/41 |
| 3,550,508 | A | 12/1970 | Wartman | |
| 3,797,195 | A * | 3/1974 | Brink et al. | 53/471 |
| 3,844,200 | A | 10/1974 | Sexstone | |
| 4,044,659 | A | 8/1977 | Bardenhagen et al. | |
| 4,184,412 | A * | 1/1980 | Hall | 493/45 |
| 4,425,107 | A | 1/1984 | Hall | |
| 4,614,263 | A * | 9/1986 | Nagata et al. | 198/418.3 |
| 4,699,606 | A * | 10/1987 | Whitley et al. | 493/4 |
| 4,740,113 | A | 4/1988 | Hirose et al. | |

(Continued)

FOREIGN PATENT DOCUMENTS

| | | | |
|---|---|---|---|
| CN | 88103264 | A | 12/1988 |
| CN | 101797074 | A | 8/2010 |

(Continued)

OTHER PUBLICATIONS

European Search Report issued Jul. 26, 2012 in European Patent Application No. 12155741.7-2313.

(Continued)

*Primary Examiner* — Christopher Harmon
(74) *Attorney, Agent, or Firm* — Venable LLP; Steven J. Schwarz

(57) ABSTRACT

An apparatus for inserting one or more objects into a filter component of a tobacco rod includes a storage apparatus that stores a plurality of the objects, each object having a predetermined volume; an inserter wheel that receives the objects stored in the storage apparatus, and inserts the objects into a band of filter material, the inserter wheel having an outer periphery with a plurality of pockets defined in the outer periphery and distributed about the outer periphery. Each pocket has a shape configured to support one of the objects with between about one quarter and about one half of the volume of the object received in the pocket. The remainder of the volume of the object protrudes from the pocket above the outer periphery of the inserter wheel. A method of inserting one or more objects into a filter component of a tobacco rod is also described.

2 Claims, 9 Drawing Sheets

(56) References Cited

U.S. PATENT DOCUMENTS

| | | | | |
|---|---|---|---|---|
| 4,827,947 | A | 5/1989 | Hinz | |
| 4,862,905 | A * | 9/1989 | Green, Jr. et al. | 131/84.1 |
| 5,542,901 | A * | 8/1996 | Atwell et al. | 493/47 |
| 5,718,250 | A | 2/1998 | Banerjee et al. | |
| 5,724,997 | A | 3/1998 | Smith et al. | |
| 6,443,160 | B1 | 9/2002 | Boldrini et al. | |
| 6,584,979 | B2 | 7/2003 | Xue et al. | |
| 6,631,722 | B2 | 10/2003 | Warren et al. | |
| 6,723,033 | B1 * | 4/2004 | Scott et al. | 493/48 |
| 6,761,174 | B2 | 7/2004 | Jupe et al. | |
| 6,805,174 | B2 | 10/2004 | Smith et al. | |
| 6,837,281 | B2 | 1/2005 | Spiers et al. | |
| 7,074,170 | B2 | 7/2006 | Lanier, Jr. et al. | |
| 7,093,625 | B2 | 8/2006 | Smith et al. | |
| 7,115,085 | B2 * | 10/2006 | Deal | 493/49 |
| 7,338,421 | B2 | 3/2008 | Eusepi et al. | |
| 7,381,175 | B2 * | 6/2008 | Dawson et al. | 493/47 |
| 7,434,585 | B2 | 10/2008 | Holmes | |
| 7,479,098 | B2 | 1/2009 | Thomas et al. | |
| 7,578,298 | B2 | 8/2009 | Karles et al. | |
| 7,654,945 | B2 | 2/2010 | Deal | |
| 7,740,019 | B2 | 6/2010 | Nelson et al. | |
| 7,784,470 | B2 | 8/2010 | Paine, III et al. | |
| 7,784,471 | B2 | 8/2010 | Paine, III et al. | |
| 7,793,665 | B2 | 9/2010 | Dube et al. | |
| 7,833,146 | B2 * | 11/2010 | Deal | 493/49 |
| 7,836,895 | B2 | 11/2010 | Dube et al. | |
| 7,878,962 | B2 | 2/2011 | Karles et al. | |
| 1,005,374 | A1 | 3/2011 | May at al. | |
| 1,005,983 | A1 | 3/2011 | Deal | |
| 1,016,266 | A1 | 7/2011 | Nikolov at al. | |
| 7,972,254 | B2 | 7/2011 | Stokes et al. | |
| 7,975,877 | B2 | 7/2011 | Garthaffner et al. | |
| 7,984,719 | B2 | 7/2011 | Dube et al. | |
| 7,997,282 | B2 | 8/2011 | Paine, Iii et al. | |
| 1,023,032 | A1 | 9/2011 | Stokes at al. | |
| 1,023,265 | A1 | 9/2011 | Dube et al. | |
| 8,142,339 | B2 * | 3/2012 | Deal | 493/48 |
| 8,262,550 | B2 * | 9/2012 | Barnes et al. | 493/39 |
| 8,475,348 | B2 * | 7/2013 | Yanchev et al. | 493/39 |
| 8,574,141 | B2 | 11/2013 | Barnes et al. | |
| 8,652,020 | B2 | 2/2014 | Davis et al. | |
| 2002/0084556 | A1 | 7/2002 | Pedigo | |
| 2003/0172942 | A1 | 9/2003 | Schlisio | |
| 2003/0224918 | A1 | 12/2003 | Lanier, Jr. et al. | |
| 2004/0237972 | A1 * | 12/2004 | Horn et al. | 131/88 |
| 2004/0250824 | A1 | 12/2004 | Gosebruch | |
| 2005/0070409 | A1 | 3/2005 | Deal | |
| 2005/0194014 | A1 | 9/2005 | Read | |
| 2005/0255978 | A1 | 11/2005 | Lanier et al. | |
| 2006/0157070 | A1 * | 7/2006 | Belcastro et al. | 131/94 |
| 2006/0252622 | A1 | 11/2006 | Kato | |
| 2006/0293157 | A1 | 12/2006 | Deal | |
| 2008/0190439 | A1 | 8/2008 | Veluz et al. | |
| 2009/0039102 | A1 | 2/2009 | Garthaffner et al. | |
| 2009/0090372 | A1 | 4/2009 | Thomas et al. | |
| 2010/0099543 | A1 | 4/2010 | Deal | |
| 2010/0101589 | A1 | 4/2010 | Nelson et al. | |
| 2010/0184576 | A1 | 7/2010 | Prestia et al. | |
| 2010/0236561 | A1 | 9/2010 | Barnes et al. | |
| 2011/0034309 | A1 | 2/2011 | Eusepi et al. | |
| 2012/0015788 | A1 | 1/2012 | Righetti et al. | |
| 2012/0065042 | A1 | 3/2012 | Le Roux | |
| 2012/0080044 | A1 | 4/2012 | Yanchev et al. | |
| 2012/0115696 | A1 | 5/2012 | Davis et al. | |
| 2012/0115697 | A1 | 5/2012 | Punzius et al. | |
| 2012/0122639 | A1 | 5/2012 | Davis et al. | |
| 2012/0220438 | A1 | 8/2012 | Herholdt et al. | |
| 2012/0245006 | A1 | 9/2012 | Henley et al. | |
| 2013/0109554 | A1 | 5/2013 | Syrzisko et al. | |
| 2013/0337987 | A1 | 12/2013 | Kato | |

FOREIGN PATENT DOCUMENTS

| | | | |
|---|---|---|---|
| CN | 101896083 | A | 11/2010 |
| DE | 102009041320 | A1 | 3/2011 |
| WO | WO-2010/055120 | A1 | 5/2010 |
| WO | WO-2010/107756 | A1 | 9/2010 |
| WO | WO-2010115829 | A1 | 10/2010 |
| WO | WO-2011024105 | A1 | 3/2011 |
| WO | WO-2012/072676 | A1 | 6/2012 |
| WO | WO-2012/076496 | A1 | 6/2012 |

OTHER PUBLICATIONS

Office Action issued in U.S. Appl. No. 13/232,150 on Nov. 7, 2014.
Chinese Office Action issued Aug. 19, 2014 in related Chinese Patent Application No. CN 201210079479.3.
Notice of Allowance issued Feb. 25, 2015 in related U.S. Appl. No. 13/232,150.
Office Action issued Sep. 11, 2015 in U.S. Appl. No. 13/709,902.

* cited by examiner

HIGH SPEED OBJECT INSERTER AND RELATED METHODS

TECHNICAL FIELD

This patent application relates generally to apparatuses and methods for manufacturing tobacco products. More specifically, this patent application relates to apparatuses and methods for inserting objects, such as capsules, into the filter component of tobacco products.

BACKGROUND

International Publication No. WO 2010/107756, which is incorporated herein by reference in its entirety, describes an apparatus and associated method for forming a rod for use in the manufacture of cigarette filter elements. A continuous supply of a filter material is formed into a continuous filter rod by a rod-forming unit. An object insertion unit is configured to insert a plurality of first objects and a plurality of second objects into the continuous filter rod. A rod-dividing unit is configured to subdivide the continuous filter rod, at predetermined intervals along the longitudinal axis thereof, into a plurality of filter rod portions such that each filter rod portion includes at least one first object and at least one second object disposed therein, with the first objects being different from the second objects.

International Publication No. WO 2010/055120, which is also incorporated herein by reference in its entirety, describes an apparatus for introducing objects into a smoking article comprising a reservoir for providing a plurality of objects to be introduced into the smoking article, a rotatable wheel for delivering the objects to the location where the objects are to be introduced into the smoking article, a transfer chamber for transferring the objects to the rotatable wheel, the transfer chamber being arranged between the reservoir and the rotatable wheel and being designed such that the objects are aligned into a single vertically arranged layer therein, and means for moving the objects from the single layer in the transfer chamber in a direction towards or along the peripheral surface of the rotatable wheel.

Due to the structure and function of these and other apparatuses known in the prior art, they are typically capable of operating at less than desired rod speeds, for example, at maximum rod speeds of approximately 85 meters per minute.

SUMMARY

According to an embodiment, an apparatus for inserting one or more objects into a filter component of a tobacco rod comprises: a storage apparatus that stores a plurality of the objects, each object having a predetermined volume; an inserter wheel that receives the objects stored in the storage apparatus, and inserts the objects into a band of filter material, the inserter wheel having an outer periphery with a plurality of pockets defined in the outer periphery and distributed about the outer periphery; wherein each pocket has a shape configured to support one of the objects with between about one quarter and about one half of the volume of the object received in the pocket, and the remainder of the volume of the object protruding from the pocket above the outer periphery of the inserter wheel. According to an embodiment, each pocket can have a shape configured to support one of the objects with about one third of the volume of the object received in the pocket, and the remainder of the volume of the object protruding from the pocket above the outer periphery of the inserter wheel.

The apparatus can further comprise a substantially conical-shaped tongue that compresses the band of filter material into a substantially cylindrical shape, wherein the inserter wheel inserts the objects directly into filter material in the tongue. The tongue can define a diameter in a region where the inserter wheel deposits the objects in the filter material, and the pockets on the inserter wheel can support the respective objects until they are delivered into the filter material to a depth equal to about one half of the tongue's diameter, thereby centering the object in the filter material. According to an embodiment, the tongue includes a substantially conical wall portion enclosing an interior region of the tongue; the wall portion defines a slot; and a portion of the inserter wheel extends through the slot and into the interior region of the tongue.

According to an embodiment, the apparatus includes a tow guide located directly upstream of the tongue, the tow guide defining a substantially cylindrical or substantially conical interior space; and a rod-shaped plow is located at least partially within the tow guide, wherein the tow guide and plow fold the band of filter material into a substantially U-shape or C-shape before entering the tongue. The rod-shaped plow can be adjustable in position with respect to the tow guide. A gathering roller can be located upstream of the tongue, wherein the gathering roller defines a circumferential profile that pre-folds the band of filter material.

According to an embodiment, the apparatus further comprises first and second metering wheels that receive the objects from the storage apparatus; and first and second intermediate wheels that receive the objects from the first and second metering wheels, respectively, and deliver the objects to the pockets in the inserter wheel. According to an embodiment, the first intermediate wheel and the second intermediate wheel can deliver the objects to alternating pockets in the inserter wheel. According to an embodiment, the first and second intermediate wheels can rotate faster than the first and second metering wheels, respectively. According to an embodiment, the first and second intermediate wheels can rotate at substantially the same speed as the inserter wheel.

According to an embodiment, the apparatus further comprises a first metering guide located between the first metering wheel and the first intermediate wheel, the first metering guide adapted to retain at least one of the objects in the first metering wheel; and a second metering guide located between the second metering wheel and the second intermediate wheel, the second metering guide adapted to retain at least one of the objects in the second metering wheel. According to an embodiment, the apparatus further comprises at least one single-plane feed chamber that supplies the objects from the storage apparatus to the first metering wheel and second metering wheel.

According to another embodiment, the apparatus comprises at least one transfer chamber that transfers the objects from the storage apparatus to the inserter wheel, wherein the transfer chamber includes an inner periphery; and at least one source of air accelerates the objects around the inner periphery of the transfer chamber. The at least one transfer chamber can include an object track defined in the inner periphery. The at least one transfer chamber can comprise a first transfer chamber and a second transfer chamber that deliver the objects to alternating pockets in the inserter wheel.

According to an embodiment, the apparatus includes a source of air associated with the plurality of pockets in the inserter wheel, wherein the source of air applies a vacuum on the pockets to draw the objects into the pockets during transportation to the filter material, and the source of air blows out of the pockets to eject the objects from the pockets upon complete delivery into the filter material.

The present invention also relates to a method of inserting one or more objects into a filter component of a tobacco rod, the method comprising: conveying a band of filter material; supporting a plurality of the objects in pockets defined on the outer periphery of a rotating inserter wheel, with between about one quarter and about one half of the volume of each object received in the respective pocket; and delivering the object into the filter material.

According to an embodiment, the method further comprises compressing the band of filter material into a filter rod using a substantially conical tongue; wherein delivering the object into the filter material comprises inserting the object directly into the filter material in the tongue through a slot defined in the tongue. The filter material can define a diameter, and the step of delivering the object into the filter material can comprise inserting the object to a depth of approximately one half of the filter material's diameter.

According to an embodiment, the method further comprises folding the filter material into a substantially U-shape or C-shape upstream of the tongue using a tow guide and plow.

According to an embodiment, the method further comprises extracting the objects from a storage apparatus using a first metering wheel and a second metering wheel; and transferring the objects from the first metering wheel and second metering wheel to a first intermediate wheel and a second intermediate wheel, respectively, wherein the first and second intermediate wheels rotate faster than the first and second metering wheels, respectively. The method can further comprise alternately transferring the objects from the first intermediate wheel and the second intermediate wheel to the pockets in the insertion wheel, wherein the insertion wheel rotates at substantially the same speed as the first and second intermediate wheels.

According to another embodiment, the method can comprise supplying the objects to a transfer chamber located proximate the inserter wheel; and accelerating the objects around an inner periphery of the transfer chamber using forced air. According to an embodiment, suction can be applied to one of the pockets to retain the object in the pocket prior to complete insertion of the object into the filter material; and subsequently, air can be blown out of the pocket upon complete insertion of the object into the filter material to eject the object from the pocket.

Further aspects, objectives, and advantages, as well as the structure and function of exemplary embodiments, will become apparent from a consideration of the description, drawings, and examples.

BRIEF DESCRIPTION OF THE DRAWINGS

The foregoing aspects and other features and advantages of the invention will be apparent from the following drawings, wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed and other methods developed without departing from the spirit and scope of the invention. All references cited herein are incorporated by reference as if each had been individually incorporated.

The present invention relates to apparatuses and methods that can be used to insert objects into a smoking article, such as the apparatuses described in International Publication Nos. WO 2010/107756 A1 and WO 2010/055120 A1, the entire contents of which are incorporated herein by reference. The apparatuses and methods of the present invention can be used to insert objects into a component of a smoking article, such as the filter material. By way of example, the objects can be beads, capsules, or pellets, however, other types of objects are also possible. The objects may be used, for example, to enhance the sensory attributes of cigarette smoke. In particular, the objects can be used as vehicles for adding flavor or other substances to the mainstream smoke. Exemplary types of filter material that can be used with the present invention include cellulose acetate tow, gathered cellulose acetate web, polypropylene tow, gathered paper, strands of reconstituted tobacco, and the like.

Figure 1:
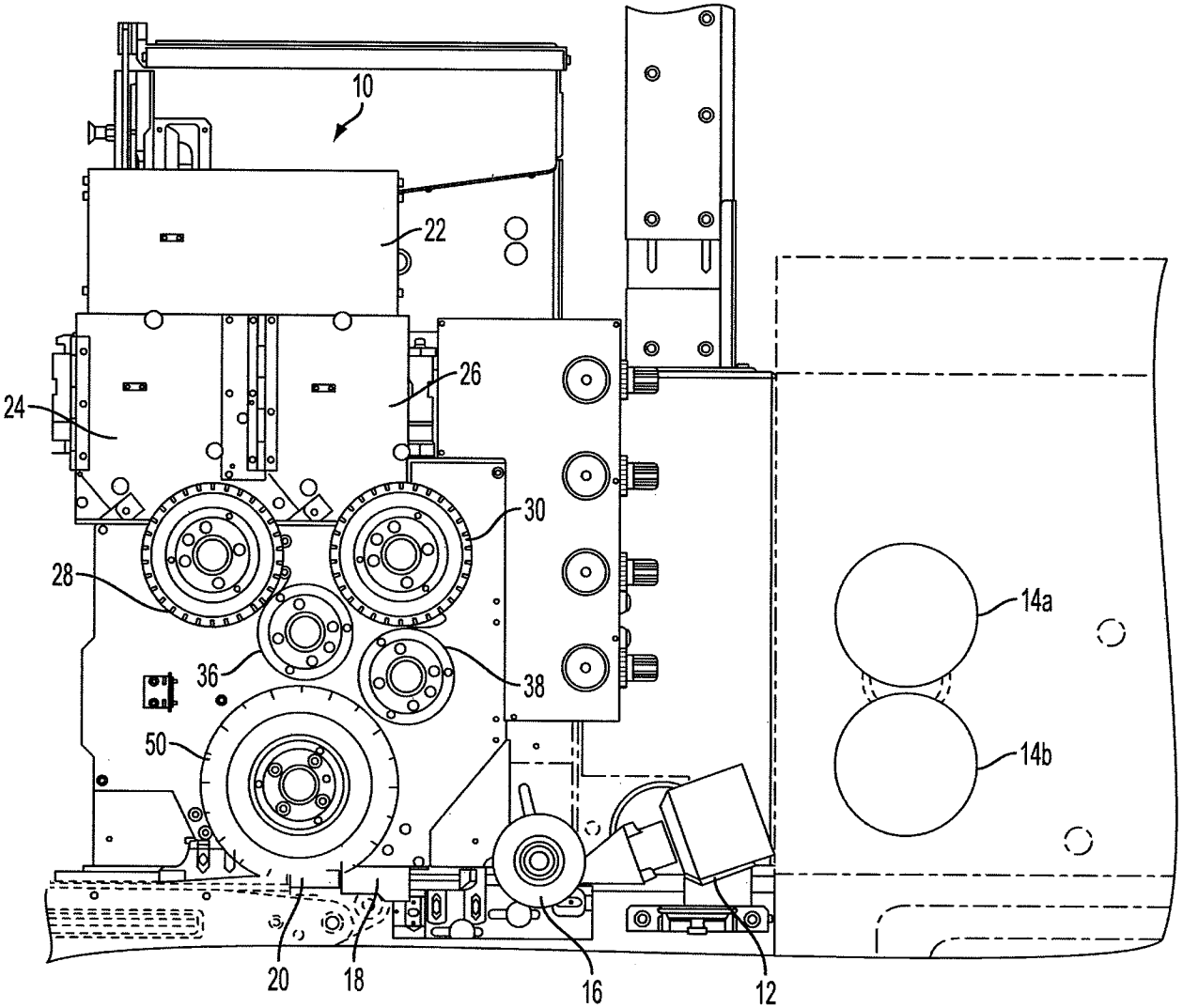
FIG. 1 is a side view of an object inserter according a first embodiment.

Referring to FIG. 1, an exemplary object inserter 10 is shown. According to an embodiment, object inserter 10 can be located upstream (to the right in FIG. 1) of a conventional rod-forming unit (not shown). Filter material can be processed using a filter material processing unit 12 (e.g., a transport jet) and passed through the rod-forming unit to form a continuous rod. The object inserter 10 may be associated with the filter material processing unit 12 and/or with the rod-forming unit to insert one or more objects within the continuous length of filter material or the continuous filter rod. The continuous filter rod can then be subdivided using a rod cutting assembly (not shown) into a plurality of rod portions each having at least one object located therein. The rod portions can be collected for further processing in a collection device, for example, a tray, a rotary collection drum, a conveying system, or the like. According to an embodiment, the rod portions can then be transported directly to a cigarette making machine. Various aspects of the object inserter 10 described herein allow operation at higher speeds than prior art object inserters.

Still referring to FIG. 1, the filter material processing unit 12 can meter a continuous band of the filter material (e.g., filter tow) from a pair of delivery rollers 14*a*, 14*b* to a gathering roller 16 associated with the object inserter 10. According to an embodiment, the gathering roller 16 can define a circumferential profile that pre-folds the band of filter material to better facilitate object insertion. For example, the gathering roller 16 can define a substantially U-shaped or V-shaped circumferential profile that bends or folds the filter material as it passes over the gathering roller 16, however, other configurations are possible.

Figure 2:
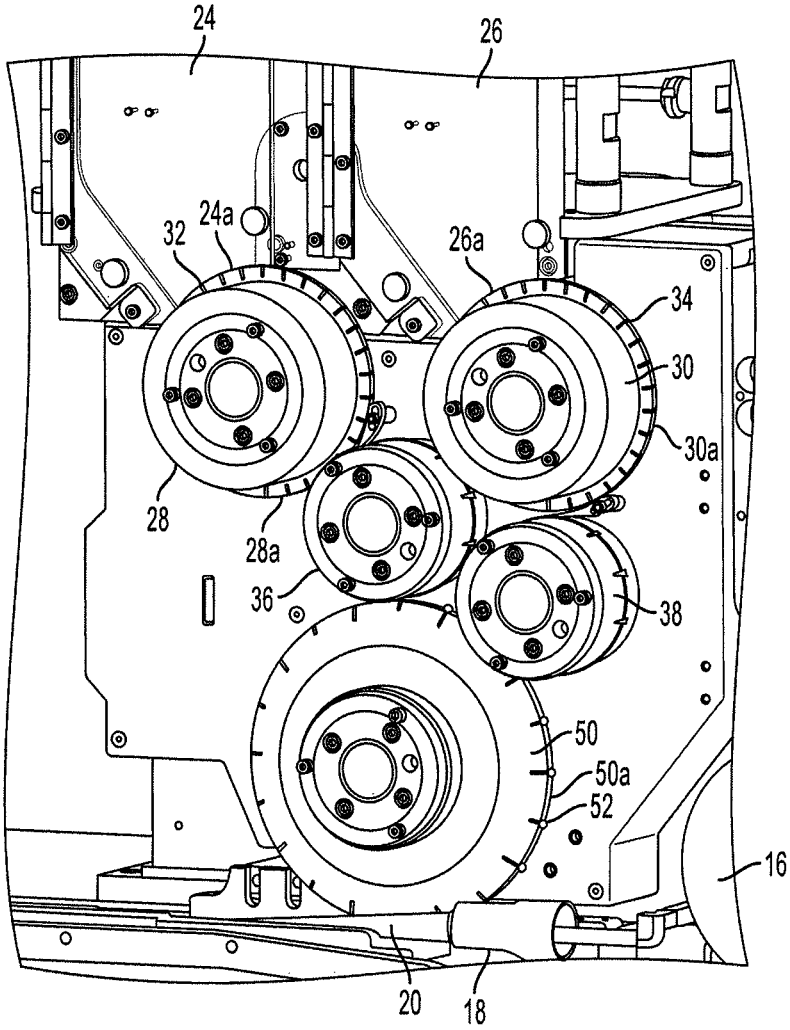
FIG. 2 is a side, perspective view of an inserter wheel, pitch wheels, metering wheels, and other components of the object inserter of FIG. 1.
Figure 5:
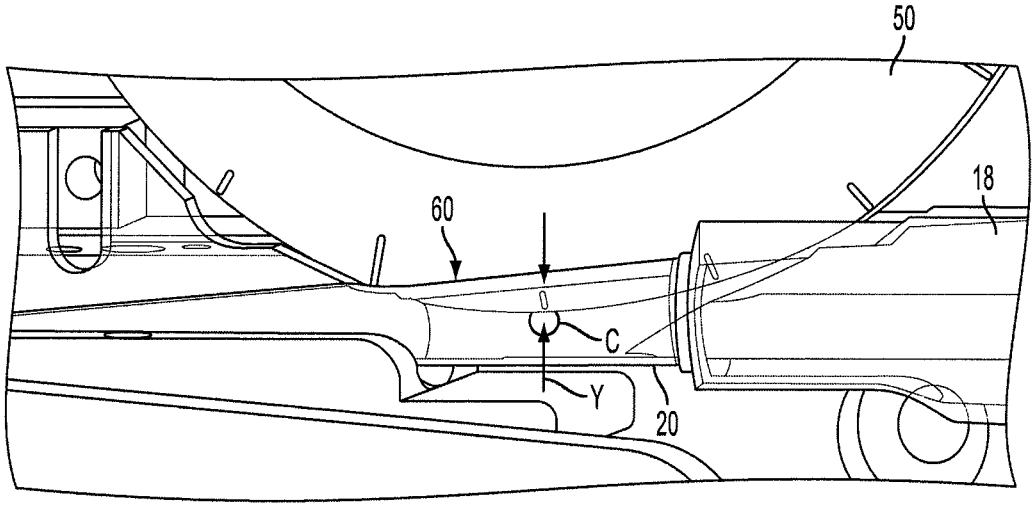
FIG. 5 is a side, perspective view of a portion of an inserter wheel and a tongue of FIG. 1.
Figure 6:
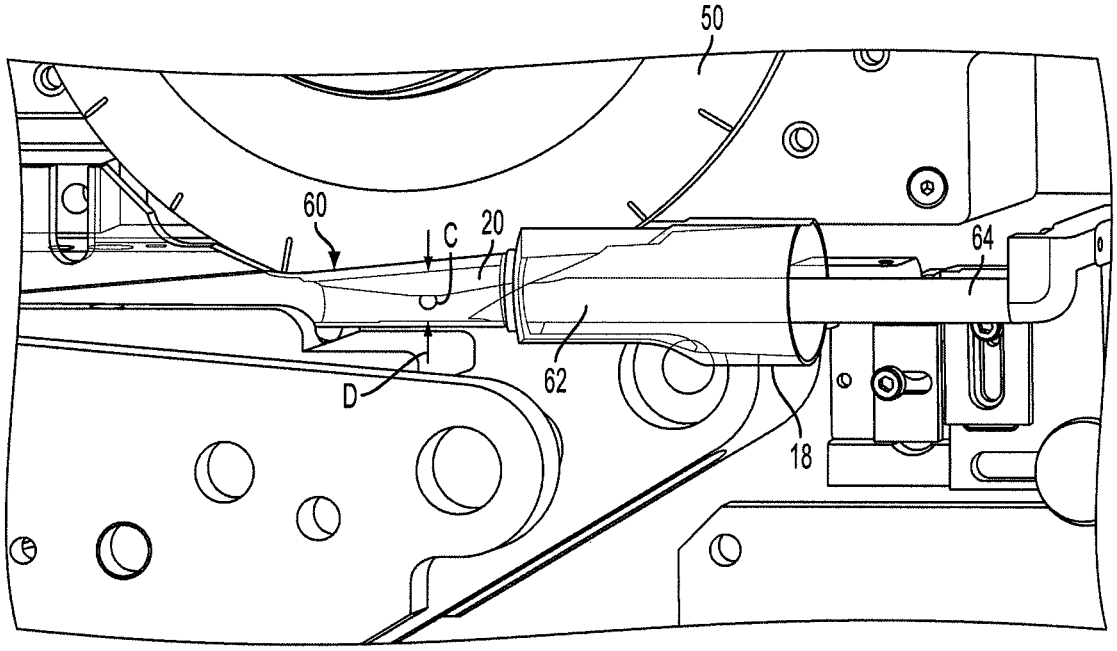
FIG. 6 is another side, perspective view of a portion of an inserter wheel and a tongue of FIG. 1.

The gathering roller 16 can feed the filter material to a tow guide 18, and then to a downstream tongue 20, as best seen in FIGS. 2, 5, and 6. After exiting the tongue 20, the filter material passes through the remainder of the rod-forming unit (not shown). Further details of the tow guide 18 and tongue 20 are discussed in detail below.

Referring back to FIG. 1, the object inserter 10 can include a storage apparatus 22, such as one or more hoppers, that stores a plurality of the objects to be inserted into the filter material. According to an embodiment, the objects can be substantially spherical in shape, and may be referred to as capsules, however, other shapes and configurations are possible. For ease of discussion, the objects will be referred to generally as "capsules" herein.

According to an embodiment, the storage apparatus 22 can feed the capsules to one or more feed chambers 24, 26, which in turn feed the capsules to first and second metering wheels 28, 30. According to an embodiment, the feed chamber 24 and/or the feed chamber 26 comprises a "single plane" feed chamber that feeds only a single plane of capsules to the periphery of the respective metering wheels 28, 30. For example, the capsules passing through the "single plane" feed chamber can be confined to an arrangement that is multiple capsules high, and multiple capsules deep, but only a single capsule wide. According to an alternative embodiment, not shown, the storage apparatus 22 can feed the capsules to one feed chamber, instead of two as shown, and the feed chamber can in turn feed the capsules to a single, or multiple, metering wheels. The storage apparatus 22 and/or the feed chambers 24, 26 can include vibrators or similar devices to assist in moving the capsules from the storage apparatus 22 to the metering wheels 28, 30.

Figure 3:
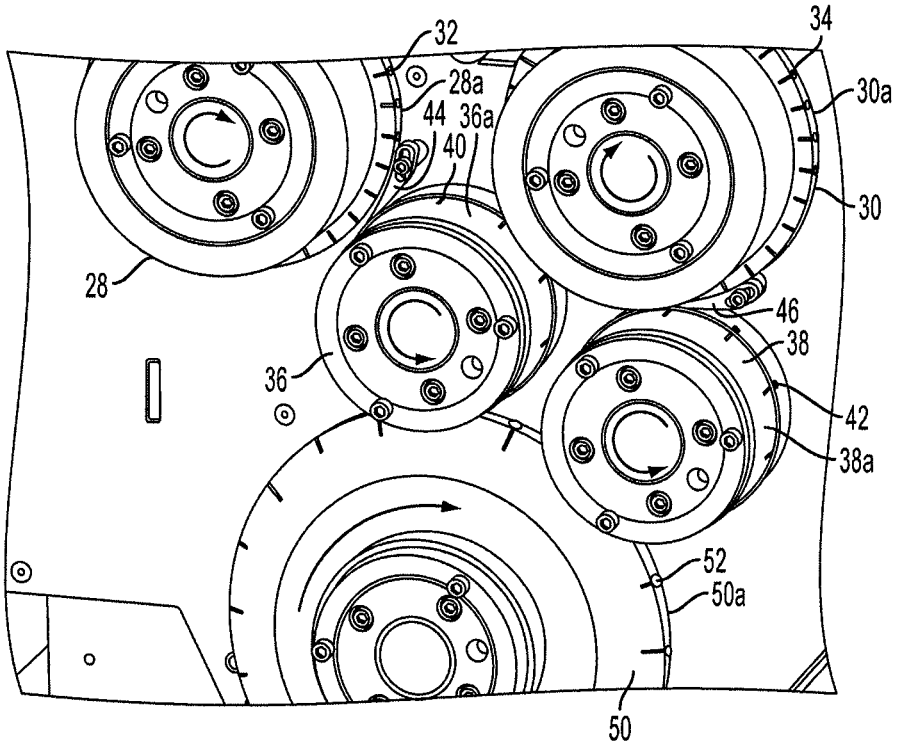
FIG. 3 is an enlarged view of a portion of FIG. 2.

Referring to FIGS. 2 and 3, the metering wheels 28, 30 are shown in more detail. The metering wheels 28, 30 each define an outer periphery 28*a*, 30*a*, a portion of which is located in registry with the lower exit ports 24*a*, 26*a* of the feed chambers 24, 26, respectively. See FIG. 2. The outer peripheries 28*a*, 30*a* can each define a set of metering wheel pockets 32, 34, which are distributed equidistantly about the respective outer peripheries 28*a*, 30*a*. The metering wheel pockets 32, 34 are adapted to receive the capsules from the lower exit ports 24*a*, 26*a* of the feed chambers 24, 26, and to transport the capsules at least partially within the metering wheels 28, 30.

According to an embodiment, the metering wheel pockets 32, 34 can be substantially cylindrical in shape, and can define a diameter and depth sufficient to receive all or a portion of the respective capsules. In the case of a cylindrical shape, the pockets can have a depth and diameter that are the same or slightly larger than the diameter of the respective capsules, in order to ensure precise positioning of the capsules within the pockets. According to alternative embodiments, the metering wheel pockets 32, 34 can be square, rectangular, conical, or other shapes known in the art, provided the pockets can securely and precisely receive and transport all or a portion of the respective capsules. A source of vacuum (not shown) can be applied to the pockets 32, 34 to aid in transfer of the capsules from the feed chambers 24, 26, and/or to aid in retention of the capsules within the pockets 32, 34 once there.

Still referring to FIGS. 2 and 3, the apparatus 10 can include intermediate wheels 36, 38 that receive capsules transferred from the metering wheels 28, 30. Referring to FIG. 3, the intermediate wheels 36, 38 can each define an outer periphery 36*a*, 38*a*, which can each define a set of intermediate wheel pockets 40, 42 distributed equidistantly about the respective outer peripheries 36*a*, 38*a*. The intermediate wheel pockets 40, 42 are adapted to receive the capsules from the metering wheels 28, 30, and to transport the capsules at least partially within the intermediate wheels 36, 38. The intermediate wheel pockets 40, 42 can be substantially the same as the metering wheel pockets 32, 34 described above, and won't be described in further detail herein. A source of vacuum (not shown) can be applied to the intermediate wheel pockets 40, 42 to aid in transfer of the capsules from the metering wheel pockets 32, 34 to the intermediate wheel pockets 40, 42, and/or to aid in retention of the capsules within the intermediate wheel pockets 40, 42 once there.

Referring to FIG. 3, a first metering guide 44 can be located between the first metering wheel 28 and the first intermediate wheel 36. Similarly, second metering guide 46 can be located between the second metering wheel 30 and the second intermediate wheel 42. The metering guides 44, 46 can aid in the transfer of capsules between the metering wheel pockets 32, 34 and the intermediate wheel pockets 40, 42, respectively. For example, the first metering guide 44 can cover or block a portion of the first intermediate wheel pockets 32 as well as a portion of the first metering wheel pockets 40 until the time, or shortly before, a metering wheel pocket 32 comes into registry with a respective intermediate wheel pocket 40. The second metering guide 46 can have a similar arrangement.

For the metering wheel pockets that are covered by the metering guides 44, 46, the source of vacuum that is normally applied to the metering wheel pockets 32, 34 can be turned off and/or substituted with a jet of air directed out of the covered metering wheel pockets 32, 34. Once one of the metering wheel pockets 32, 34 rotates past the metering guide 44, 46, and is no longer blocked thereby, the jet of air may propel the capsule out of that metering wheel pocket and into the intermediate wheel pocket 40, 42 that is in registry therewith at that point in time. As a result, the metering, guides 44, 46 can allow the jet of air that blasts the capsules out of the pockets to be applied earlier than if there were no metering guides 44, 46, without the risk of prematurely ejecting the capsules from the metering wheel pockets 32, 34. Accordingly, the speed and consistency at which capsules are transferred from the metering wheel pockets 32, 34 to the intermediate wheel pockets 40, 42 can be improved.

Still referring to FIGS. 2 and 3, the apparatus 10 can include an inserter wheel 50 that receives capsules from the intermediate wheels 36, 38 and inserts them into the band of filter material, for example, as it passes through the tongue 20 of the rod-forming unit. The inserter wheel 50 can define an outer periphery 50*a* having a plurality of inserter wheel pockets 52 distributed equidistantly about the outer periphery 50*a*. The inserter wheel pockets 52 at least partially receive the capsules and support them on the inserter wheel 50, as will be described in more detail below. A source of vacuum (not shown) can be applied to the inserter wheel pockets 52 to aid in transfer of the capsules from the intermediate wheel pockets 40, 42 to the inserter wheel pockets 52, and/or to aid in retention of the capsules within the intermediate wheel pockets 52 once there.

The arrangement of the metering wheels 28, 30, intermediate wheels 36, 38, and inserter wheel 50 described above can help facilitate faster operation of the object inserter 10. For example, the metering wheels 28, 30 can operate at a relatively low speed (e.g., measured at the outer peripheries 28*a*, 30*a*) to ensure consistent transfer of the capsules from the feed chambers 24, 26 to the respective metering wheel pockets 32, 34. Simultaneously, the inserter wheel 50 can insert the capsules into the filter material at a high delivery speed, for a fast production rate.

According to an embodiment, a pitch increase and speed increase can occur upon transfer from the metering wheels 28, 30 to the intermediate wheels 36, 38. For example, according to an embodiment, the first and second intermediate wheels 36, 38 can rotate faster than the respective metering wheels 28, 30. Additionally or alternatively, the intermediate wheel pockets 40, 42 can be arranged at a greater pitch than the metering wheel pockets 32, 34.

According to an embodiment, faster speeds can be provided by alternately transferring capsules from the first and second intermediate wheel pockets 40, 42 to the inserter wheel pockets 52. For example, an intermediate wheel pocket 40 in the first intermediate wheel 36 can transfer a capsule to an inserter wheel pocket 52, and subsequently an intermediate wheel pocket 42 in the second intermediate wheel 38 can transfer a capsule to the immediate next inserter wheel pocket 52, and so on. A pitch increase and/or a speed increase can also occur upon transfer from the intermediate wheels 36, 38 to the inserter wheel 50. According to an embodiment, the first intermediate wheel. 36, second intermediate wheel 38, and inserter wheel 50 can rotate at substantially the same speed, although other configurations are possible. For example, the inserter wheel 50 could alternatively rotate faster or slower than the first and second intermediate wheels 36, 38.

The following table lists exemplary parameters for operation of an object inserter 10:

TABLE A

| Wheel Set | Holes/ Wheel | Wheel Dia. (mm) | Operating RPM | Surface speed |
|---|---|---|---|---|
| Metering Wheels | 30 each | 137.5 | 133⅓ | 57.6 M/min |
| Intermediate Wheels | 10 each | 95 | 400 | 119.38 M/min |
| Inserter Wheels | 20 | 190 | 400 | 238.76 M/min |

When used to form 108 mm filter rods having four capsules per filter, an embodiment of object inserter 10 using the above parameters resulted in a machine speed of approximately 216 meters of filter material per minute, for an output of 2,000 filters per minute (8,000 capsules per minute). One of ordinary skill in the art will recognize from this description that other parameters than those described above can be used.

Although the embodiment shown in FIGS. 1-6 has two metering wheels 28, 30 and two intermediate wheels 36, 38, one of ordinary skill in the art will appreciate based on this description that alternative embodiments may employ a single metering wheel and/or a single intermediate wheel. Likewise, one of ordinary skill in the art will appreciate based on this description that alternative embodiments may have more than two metering wheels and/or more than two intermediate wheels. Furthermore, while the embodiment shown in FIGS. 1-6 includes two feed chambers 24, 26, one of ordinary skill in the art will understand based on this description that a single feed chamber, or more than two feed chambers, may be used.

Figure 4:
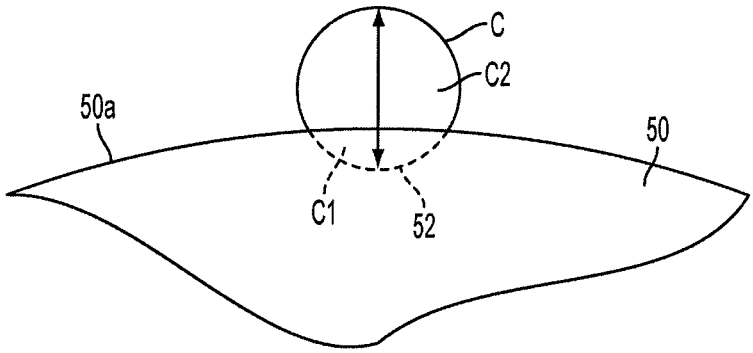
FIG. 4 is a side, schematic representation of a portion of the inserter wheel of FIG. 1, showing an object supported by a pocket in the inserter wheel.

Referring to FIG. 4, a portion of an inserter wheel 50 having an inserter wheel pocket 52 is shown in detail. The object inserter 10 can be designed to operate with a capsule C having a predetermined shape and volume. For ease of description, the invention will be described in connection with a spherical capsule C, however, as mentioned previously, other shapes and sizes of capsules are possible.

In order to facilitate accurate placement of the capsule C in the filter material, the inserter wheel pocket 52 can support the capsule C such that a portion C1 of the capsule C, for example, between about one quarter and about one half of the capsule's volume, resides inside the pocket 52, with the remainder C2 of the capsule C protruding from the pocket 52 above the outer periphery 50*a* of the inserter wheel 50. As a result, the inserter wheel 50 can manually insert the capsule to substantially its desired position within the filter material, without having to rely on forced air to "shoot" the capsule C out of a deep pocket and to its desired position, resulting in higher control and accuracy in placing the capsule C, and/or allowing for higher operating speeds.

As shown in FIG. 4, for cylindrical capsules C, the inserter wheel pocket 52 can be shaped as a portion of a sphere, however, other configurations of the pocket 52 are possible. For example, the inserter wheel pocket can comprise a plurality of discreet surfaces that contact and support different points on the surface of the capsule C (e.g., a cylindrical pocket may be dimensioned to receive and support a portion of a spherical capsule C). According to an embodiment, the inserter wheel pockets 52 are configured to receive and support approximately one third of the total volume of the capsule C, with the remainder of each capsule's volume protruding from the inserter wheel pocket 52 and above the outer periphery 50*a* of the inserter wheel.

Referring to FIGS. 5 and 6, an embodiment is shown where the inserter wheel 50 inserts the capsules C directly into the tongue 20 of the rod forming unit. As shown, the tongue 20 can comprise a substantially conical shaped wall that compresses the band of filter material as it is drawn through the tongue 20, causing the filter material to take on a cylindrical shape. A slot 60 can extend through the conical wall along the direction of movement of the filter material, and a portion of the inserter wheel 50 can extend through the slot 60 into the interior of the tongue 20. As a result of this configuration, the inserter wheel 50 can deposit the capsule C directly into the filter material as it is being compressed by the tongue 20. By inserting the capsule C into the filter material as close to the rod formation point as reasonably possible, the capsule C may retain its desired position within the filter material.

Still referring to FIGS. 5 and 6, the inserter wheel pocket 52 can remain in contact and provide positive support to the capsule C until the capsule C is nearly or completely moved to the desired position within the filter material. For example, referring to FIG. 6, the conical wall of the tongue 20 may define an inner diameter D at the point where the capsule C is to be inserted into the filter material, and the tongue 20 may shape the filter material to have substantially the same diameter at that point. The inserter wheel 50 and inserter wheel pocket 52 may actively support the capsule C until the inserter wheel 50 positions the capsule C at a depth Y within the tongue 20, shown in FIG. 5. According to an embodiment, the depth Y may be substantially one half of the diameter D of the tongue 20, causing the capsule C to be deposited substantially centered within the filter material, however, other configurations are possible. Once the inserter wheel 50 and inserter wheel pocket 52 have moved the capsule to its desired position within the filter material, as shown in FIGS. 5 and 6, the vacuum that is normally applied to the inserter wheel pockets can be optionally switched to a short blast of positive air pressure, for example, to speed up the release of the capsule C from the respective inserter wheel pocket 52.

According to an embodiment, the linear speed of the outer periphery 50*a* of the inserter wheel 50, and hence the inserter wheel pockets 52, can be greater than the linear speed of the filter material through the tongue 20. This arrangement can result in greater accuracy in placing the capsules C in the filter material.

Still referring to FIGS. 5 and 6, a tow guide 62 and rod-shaped plow 64 can be located upstream of the tongue 20. The tow guide 62 can define a substantially conical or substantially cylindrical inner space. The plow 64 can extend longitudinally within the tow guide 62 and, together with the plow 64, can pre-form or pre-fold the filter material into a substantial C-shape or U-shape prior to entering the tongue 20. As a result of the substantial C-shape or U-shape pre-forming of the filter material, the inserter wheel 50 can insert the capsule C through the opening in the C-shaped or U-shaped filter material, and into the approximate center of the folded filter material. As a consequence of this configuration, the folded filter material may more reliably hold the capsule C in its desired position within the filter material and resulting filter. According to an embodiment, the position of the plow 64 can be adjusted with respect to the tow guide 62, for example, along the longitudinal axis of the tow guide 62.

Figure 7:
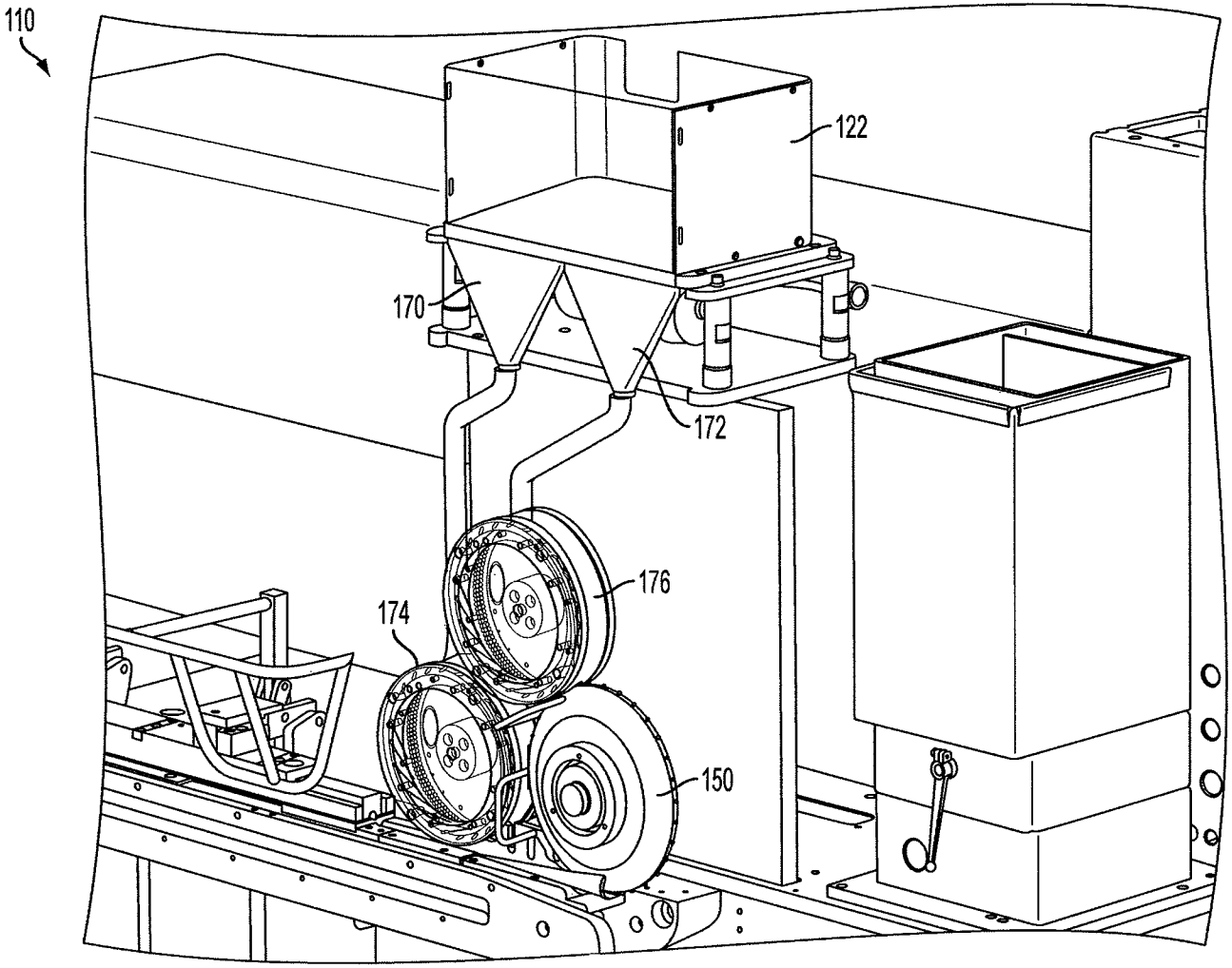
FIG. 7 is a side, perspective view of an object inserter according to a second embodiment.
Figure 8:
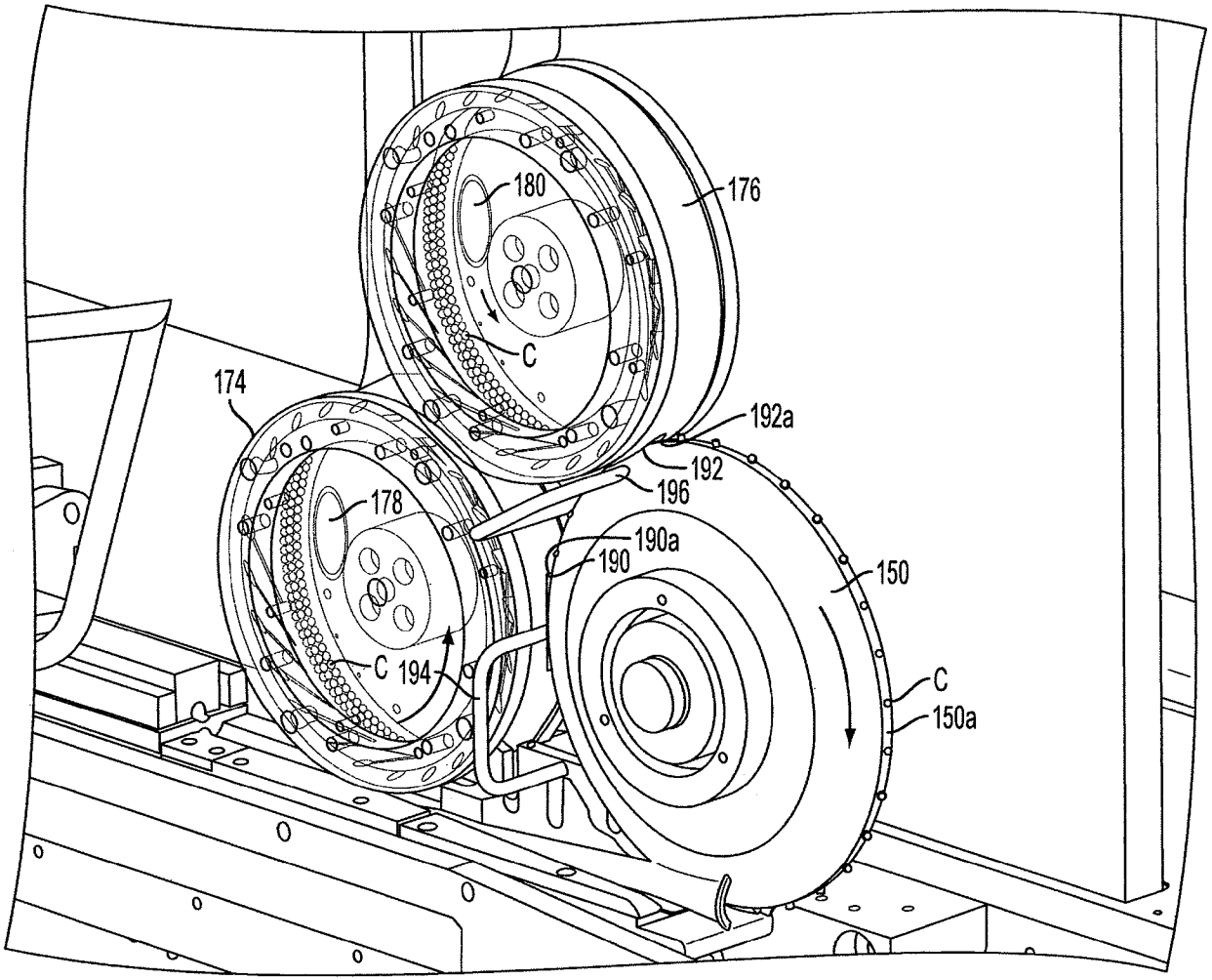
FIG. 8 is a side, perspective view of an inserter wheel, acceleration chambers, and other components of the object inserter of FIG. 7.
Figure 9:
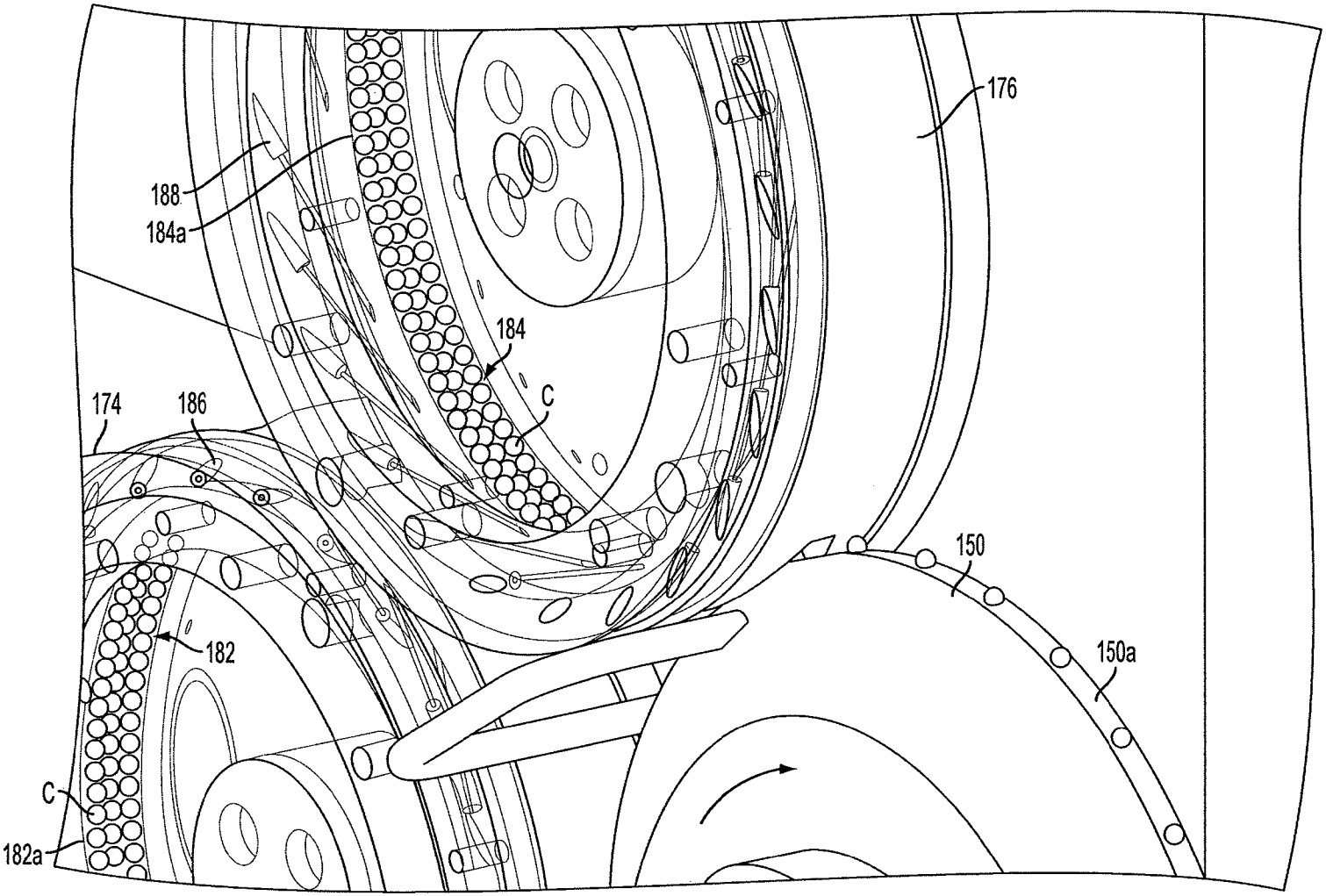
FIG. 9 is an enlarged view of a portion of FIG. 8.

Referring to FIGS. 7-9, a second embodiment of an object inserter is shown. For purposes of this description, the object inserter 110 of FIGS. 7-9 differs from the object inserter 10 shown in FIGS. 1-6 only in the structure and function of delivering the objects (e.g., capsules) from the storage apparatus 122 to the inserter wheel 150. Accordingly, for ease of explanation, discussion of structures and functions that are the same as, or substantially similar to, the embodiment of FIGS. 1-6 will be not be repeated.

Referring to FIG. 7, the object inserter 110 can generally include first and second gravity feeders 170, 172 that feed the capsules from the storage apparatus 122 to first and second transfer chambers 174, 176, respectively. Although not shown, shutters, valves, or other metering devices can be used to meter the flow of capsules from the storage apparatus 122 to the first and second transfer chambers 174, 176, respectively, as will be apparent to one of ordinary skill in the art based on this description. Although the embodiment shown in FIG. 7 has two gravity feeders 170, 172 and two transfer chambers 174, 176, one of ordinary skill in the art will appreciate based on this description that alternative embodiments may employ only a single gravity feeder and a single transfer chamber, or alternatively, more than two gravity feeders and more than two transfer chambers.

Referring to FIG. 8, the first and second transfer chambers 174, 176 and inserter wheel 150 are shown in more detail. The first and second transfer chambers 174, 176 can be adapted to accelerate the capsules C to a speed that is substantially equal to the linear speed of the periphery 150*a* of the inserter wheel 150, and hence the inserter wheel pockets (not shown), to facilitate reliable and consistent transfer of the capsules C to the inserter wheel pockets when operating at high speed. To further facilitate high speed delivery of the capsules C by the inserter wheel 150, the first and second transfer chambers 174, 176 can take turns supplying a capsule C to alternating pockets 152 in the inserter wheel 150.

Referring to FIG. 8, the first and second gravity feeders 170, 172 can deliver a continuous supply of the capsules C to the interior of the first and second transfer chambers 174, 176, respectively, through inlet ports 178, 180. Each transfer chamber 174, 176 defines an inner peripheral surface 182, 184, shown in FIG. 9. In the embodiment of FIGS. 7-9, the inner peripheral surfaces 182, 184 are substantially circular, however other shapes are possible, for example, elliptical.

Referring to FIG. 9, the inner peripheral surfaces 182, 184 can define tracks 182*a*, 184*a* that guide the capsules C around the inner peripheral surfaces in a predetermined pattern. A plurality of air nozzles 186, 188, act on the capsules C located in the tracks 182*a*, 184*a* to accelerate the capsules C around the inner peripheral surfaces 182, 184 within the tracks 182*a*, 184*a*, respectively, until the capsules C reach a linear speed substantially equal to the linear speed of the inserter wheel pockets (not shown) on the inserter wheel 150.

Referring back to FIG. 8, each transfer chamber 174, 176 can include an exit 190, 192 (e.g., an elongated slot through the peripheral surfaces 182, 184) located along the tracks 182*a*, 184*a*. A portion of the outer periphery 150*a* of the inserter wheel 150 can extend through each exit 190, 192. The tracks 182*a*, 184*a* can be configured to guide the capsules C around the inner peripheral surfaces 182, 184, under the force of the air nozzles 186, 188, until the capsules C reach the respective exit 190, 192. Upon reaching the respective exit 190, 192, the capsule C may be at the same or similar linear speed as the outer periphery 150*a* of the inserter wheel 150, and will transition into an inserter wheel pocket (not shown) on the inserter wheel 150. Vacuum force applied to the inserter wheel pocket may assist with the transfer and retention of the capsule C into the inserter wheel pocket. In addition, according to an embodiment, a brush (not shown) may be located inside each transfer chamber 174, 176 at the trailing edge 190*a*, 192*a* of each exit 190, 192 to aid in transfer of the capsules C to the inserter wheel pockets. In addition, air nozzles 194, 196 may direct an air curtain at each exit 190, 192, respectively, to protect the respective exit 190, 192, and/or to blow away extra capsules C that may erroneously pass through the exit 190, 192.

The structures and operations discussed above can be utilized in methods to insert one or more objects into a filter component of a tobacco rod, as will be appreciated by one of ordinary skill in the art based on this description. As mentioned previously, the structures and operations described herein can result in a significant increase in speed and reliability as compared to prior art apparatuses and methods. For example, the apparatus shown in FIGS. 1-6 has been operated with the parameters listed in Table A, above, to form 108 mm filter rods having four capsules per filter, at a rate of approximately 216 meters of filter material per minute (output of 2,000 filters per minute), and with high consistency and reliability. This output speed is dramatically faster that what is possible with prior art machines, which have typically been limited to speeds of approximately 80 meters per minute to reliably produce similar filter rods. One of ordinary skill in the art will appreciate from this description that the parameters listed in Table A can be varied to provide similar high output speeds to prepare filter rods having different configurations.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. An apparatus for inserting one or more objects into a filter component of a tobacco rod, the apparatus comprising:

a storage apparatus that stores a plurality of the objects, each object having a predetermined volume;

an inserter wheel that receives the objects stored in the storage apparatus, and inserts the objects into a band of filter material, the inserter wheel having an outer periphery with a plurality of pockets defined in the outer periphery and distributed about the outer periphery;

at least one transfer chamber that transfers the objects from the storage apparatus to the inserter wheel, wherein the transfer chamber includes a substantially circular inner periphery having an object track extending around the substantially circular inner periphery, the transfer chamber further including an exit slot extending along the object track, at least a portion of the inserter wheel extending into the exit slot; and a plurality of air nozzles located within the at least one transfer chamber that accelerate the objects around the inner periphery of the transfer chamber within the object track;

wherein each pocket has a shape configured to support one of the objects with between about one quarter and about one half of the volume of the object received in the pocket, and the remainder of the volume of the object protruding from the pocket above the outer periphery of the inserter wheel.

2. The apparatus of claim 1, wherein the at least one transfer chamber comprises a first transfer chamber and a second transfer chamber that deliver the objects to alternating pockets in the inserter wheel.

* * * * *